US005314320A

United States Patent [19]

Shimizu et al.

[11] Patent Number: 5,314,320

[45] Date of Patent: May 24, 1994

[54] SCREW VACUUM PUMP WITH A REDUCED STARTING LOAD

[75] Inventors: Noburu Shimizu; Kiyoshi Yanagisawa, both of Kanagawa, Japan

[73] Assignee: Ebara Corporation, Tokyo, Japan

[21] Appl. No.: 907,033

[22] Filed: Jul. 1, 1992

[30] Foreign Application Priority Data

Jul. 10, 1991 [JP] Japan ..... 3-195943

[51] Int. Cl.[5] ..... F01C 1/16; F01C 1/24

[52] U.S. Cl. ..... 418/201.1; 418/9

[58] Field of Search ..... 418/201.1, 201.2, 9

[56] References Cited

U.S. PATENT DOCUMENTS

| | | | |
|---|---|---|---|
| 3,151,806 | 10/1964 | Whitfield | 418/201.2 |
| 4,068,984 | 1/1978 | Spindler | 418/201.1 |
| 4,220,197 | 9/1980 | Schaefer et al. | 165/35 |
| 4,667,646 | 5/1987 | Shaw | 418/201.2 |
| 5,051,077 | 9/1991 | Yanagisawa et al. | 418/201.1 |

FOREIGN PATENT DOCUMENTS

| | | | |
|---|---|---|---|
| 60-216089 | 10/1985 | Japan . | |
| 61-152990 | 7/1986 | Japan . | |
| 61-223295 | 10/1986 | Japan . | |
| 61-234290 | 10/1986 | Japan . | |
| 22948 | 1/1990 | Japan . | |
| 27268 | 2/1990 | Japan . | |
| 0146288 | 6/1990 | Japan | 418/201.2 |
| 747058 | 3/1956 | United Kingdom . | |
| 2193534 | 2/1988 | United Kingdom . | |

OTHER PUBLICATIONS

Patent Abstracts of Japan, vol. 12, No. 169, (M-699), May 20, 1988, & JP-A-62 284 994, Dec. 10, 1987, Tsuru Seiji, et al., "Method for Starting Multistage Screw Vacuum Pump".

Patent Abstracts of Japan, vol. 14, No. 271, (M-983), Jun. 12, 1990, & JP-A-20 78 783, Mar. 19, 1990, Uchida Riichi, et al., "Screw Vacuum Pump".

*Primary Examiner*—Richard A. Bertsch
*Assistant Examiner*—Charles G. Freay
*Attorney, Agent, or Firm*—Oblon, Spivak, McClelland, Maier & Neustadt

[57] ABSTRACT

A screw vacuum pump is designed so that it is possible to reduce the load on the pump at the time of starting and evacuation of a gas under atmospheric pressure. The screw vacuum pump has male and female rotors rotating in mesh with each other around two parallel axes, respectively, and a casing for accommodating the rotors, the casing having a suction port and a discharge port, wherein the discharge port is formed so that $V_1/V_2$ is in the range of 1.5 to 0.51, where $V_1$ is a groove volume defined by the casing and the male and female rotors immediately after a gas has been trapped, and $V_2$ is a groove volume immediately before the gas is discharged.

5 Claims, 2 Drawing Sheets

SCREW VACUUM PUMP WITH A REDUCED STARTING LOAD

BACKGROUND OF THE INVENTION

Field of the Invention

The present invention relates to a screw vacuum pump and, more particularly, to a screw vacuum pump which is designed so that it is possible to reduce the load on the pump at the time of starting and evacuation of a gas under atmospheric pressure.

There has heretofore been one type of screw vacuum pump which has a pair of male and female rotors rotating in mesh with each other around two parallel axes, respectively, and a casing for accommodating the two rotors, the casing having a suction port and a discharge port. The operation of the screw vacuum pump comprises a process of sucking a gas from the suction port into a space defined between the rotors, a process of compressing the gas inside the rotors, and a process of discharging the gas from the discharge port.

An advantageous way of obtaining a high degree of vacuum in the screw vacuum pump having the above-described arrangement is to increase the built-in volume ratio, that is, the compression ratio. However, in such a case, excessive power is needed at the time of starting and when a gas of atmospheric pressure is evacuated from the chamber during the top-speed operation. The following measures have heretofore been used in order to cope with the above-described problem:

(1) A method wherein a throat is attached to the suction pipe to lower the pressure of the gas sucked into the pump.

(2) A method wherein a gas relief mechanism is provided for groove spaces where high pressure is produced.

(3) A method wherein the rotating speed is lowered by using an inverter or the like.

(4) A method wherein a motor of large capacity is used.

The conventional methods (1) to (4) suffer, however, from the following disadvantages: Method (1) causes a lowering in the pumping speed and hence takes much time to evacuate the chamber. Method (2) leads to an increase in cost and lacks reliability. Method (3) leads to an increase in cost because of the need for an inverter or the like to change the rotating speed. Method (4) lacks compactness and leads to an increase in cost because of the use of a motor of large capacity.

SUMMARY OF THE INVENTION

In view of the above-described circumstances, it is an object of the present invention to provide a screw vacuum pump which is designed so that it is possible to reduce the load on the pump at the time of starting and evacuation of a gas of atmospheric pressure and yet possible to obtain a high degree of vacuum.

To solve the above-described problems, the present invention provides a screw vacuum pump having a pair of male and female rotors rotating in mesh with each other around two parallel axes, respectively, and a casing for accommodating the two rotors, the casing having a suction port and a discharge port, wherein a rotor rotation angle at which the suction port closes a groove space formed by the casing and the male and female rotors is set at an angle at which the volume of the groove space has not yet reached a maximum, and the discharge port is formed so that $V_1/V_2$ is about 1, where $V_1$ is a groove volume defined by the casing and the male and female rotors immediately after a gas has been trapped, and $V_2$ is a groove volume immediately before the gas is discharged.

In addition, the present invention is characterized in that a plurality of screw vacuum pumps having the above-described arrangement are connected in series in a multi-stage structure.

In addition, the present invention is characterized in that the pumping speed of each screw vacuum pump is either approximately equal to or higher than that of the preceding screw vacuum pump.

The power needed at the time of evacuation of a gas of atmospheric pressure can be reduced by setting the compression ratio at 1. However, in the prior art the trapping position of the suction port is set at a position where the groove volume reaches a maximum; therefore, if the compression ratio is reduced, the number of groove spaces present between the suction and discharge ports decreases, so that leakage of gas to the suction side increases, resulting in a lowering in the degree of vacuum attained. In contrast, if the suction port is closed early, the groove volume $V_1$ is relatively small, so that if the compression ratio is set at around 1 (in the range of 1.5 to 0.51), the groove volume immediately before the groove space opens to the discharge port also decreases. It is therefore possible to delay the timing at which the groove space opens to the discharge port. Accordingly, although the compression ratio is around 1, a large number of groove spaces are present between the discharge and suction ports, and it is therefore possible to attain a high degree of vacuum.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein.

DESCRIPTION OF THE PREFERRED EMBODIMENTS

Figure 2:
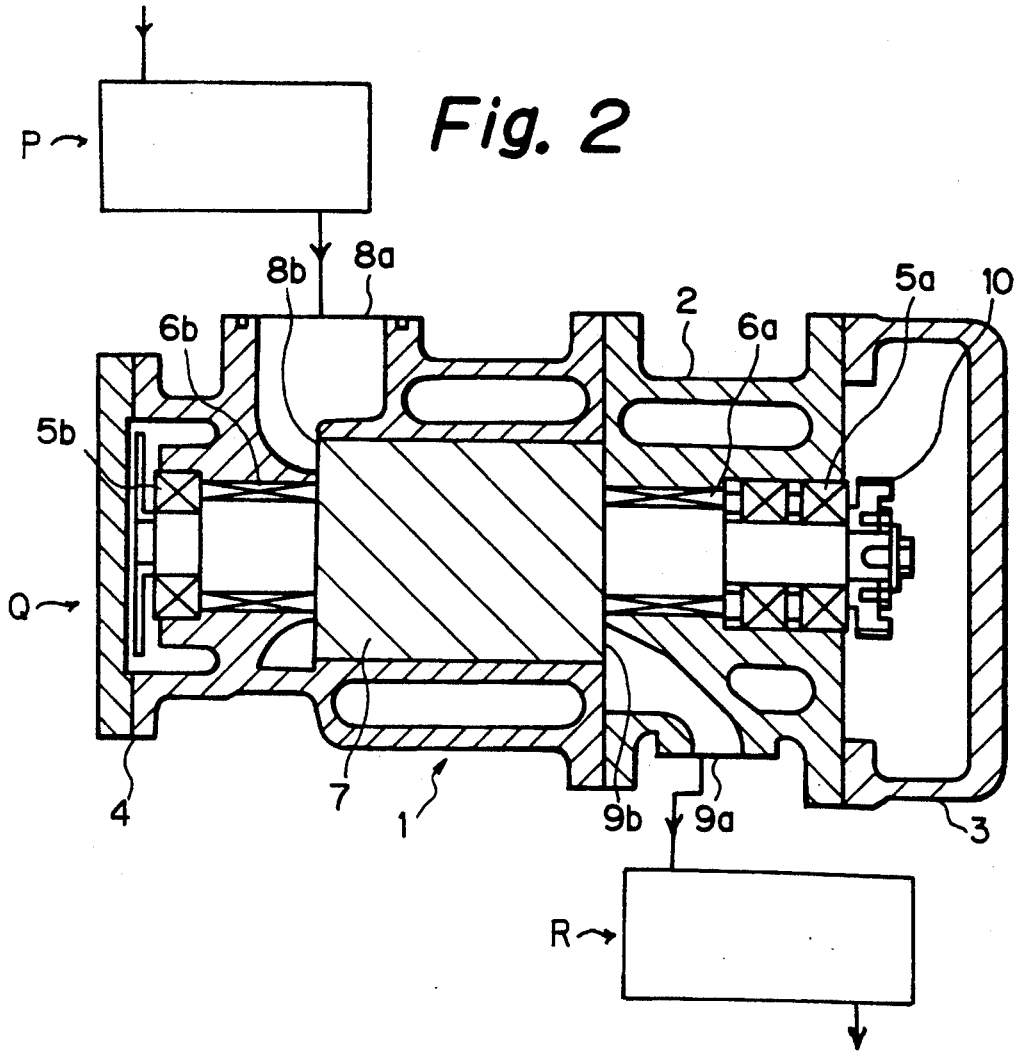
FIG. 2 is a sectional side view showing the structure of the screw vacuum pump according to the present invention.
Figure 3:
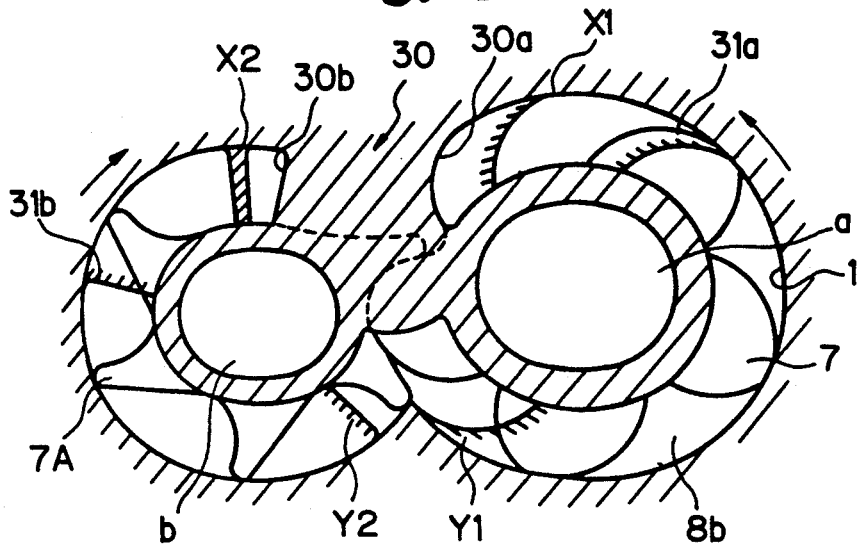
FIG. 3 is a sectional view taken along a plane perpendicular to the axes of the male and female rotors, showing the structure of the screw vacuum pump according to the present invention.

Embodiments of the present invention will be described below with reference to the accompanying drawings. FIGS. 2 and 3 show the structure of the screw vacuum pump according to the present invention. FIG. 2 is a sectional side view of the pump, and FIG. 3 is a sectional view taken along a plane perpendicular to the axes of a pair of male and female rotors. The screw vacuum pump has a main casing 1, a discharge casing 2, and a pair of male and female rotors 7 and 7A, which are rotatably supported by respective bearings 5a and 5b in a space defined between the main and discharge casings 1 and 2. The male and female rotors 7 and 7A are sealed off from lubricating oil used for the bearings 5a and 5b by respective shaft seals 6a and 6b. FIG. 2 also shows schematically a plurality of screw vacuum pumps P, Q, R connected in series in a multi-stage structure forming a pump apparatus.

In the meantime, for example, the male rotor 7 is driven by an electric motor (not shown) through a speed change gear (not shown), while the female rotor 7A is rotated through a timing gear 10 with a small clearance formed between the same and the male rotor 7.

A gas that is sucked in from a suction opening 8a is introduced through a suction port 8b into a groove space that is defined by the main casing 1 and the two rotors 7 and 7A, and the gas then undergoes expansion and compression processes as described hereafter before being discharged from a discharge opening 9a through a discharge port 9b. Reference numerals 3 and 4 in FIG. 2 denote a gear cover and a cover, respectively.

Figure 1:
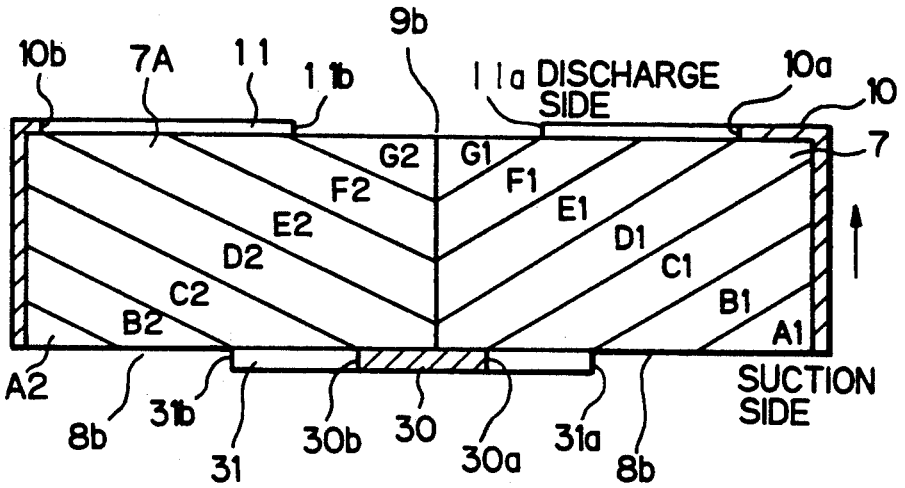
FIG. 1 shows the way in which a pair of male and female rotors are in mesh with each other in a view developed in the circumferential direction of the rotors.

FIG. 1 shows the way in which the male and female rotors 7 and 7A are in mesh with each other in a view developed in the circumferential direction of the rotors. In FIG. 1, reference symbols A1 to G1 and A2 to G2 denote pairs of corresponding groove spaces of the rotors 7 and 7A. A pair of groove spaces D1 and D2 define a maximum groove volume. In the prior art, since the trapping position of the suction port 8b is set at a position where the groove volume reaches a maximum, if the internal volume ratio (i.e., $V_1/V_2$, where $V_1$ is a groove volume defined by the casing and the male and female rotors immediately after a gas has been trapped, and $V_2$ is a groove volume immediately before the gas is discharged) is reduced, the number of groove spaces present between the suction and discharge ports decreases. That is, the suction port 8b is closed at points 30a and 30b, and the discharge port 9b opens at points 10a and 10b, so that there is only one pair of groove spaces D1 and D2 between the discharge and suction ports 9b and 8b. Accordingly, leakage of gas to the suction side is large, so that it is difficult to attain a high degree of vacuum.

In contrast, the present invention can attain a high degree of vacuum due to the following reason: If the suction port 8b is closed early, the groove volume $V_1$ is relatively small; therefore, if the internal volume ratio is set at 1, the groove volume $V_2$ immediately before the groove space opens to the discharge port 9b can also be made relatively small, so that it is possible to delay the timing at which the groove space opens to the discharge port 9b. Accordingly, although the internal volume ratio is 1, a large number of spaces are present between the discharge and suction ports 9b and 8b, and it is therefore possible to attain a high degree of vacuum. More specifically, the suction port 8b is closed at points 31a and 31b, while the discharge port 9b opens at points 11a and 11b, and there are groove spaces C2–C1, D2–D1, E2–E1 and F2–F1 therebetween. Thus, it is possible to prevent leakage of gas from the discharge side to the suction side.

Figure 4:
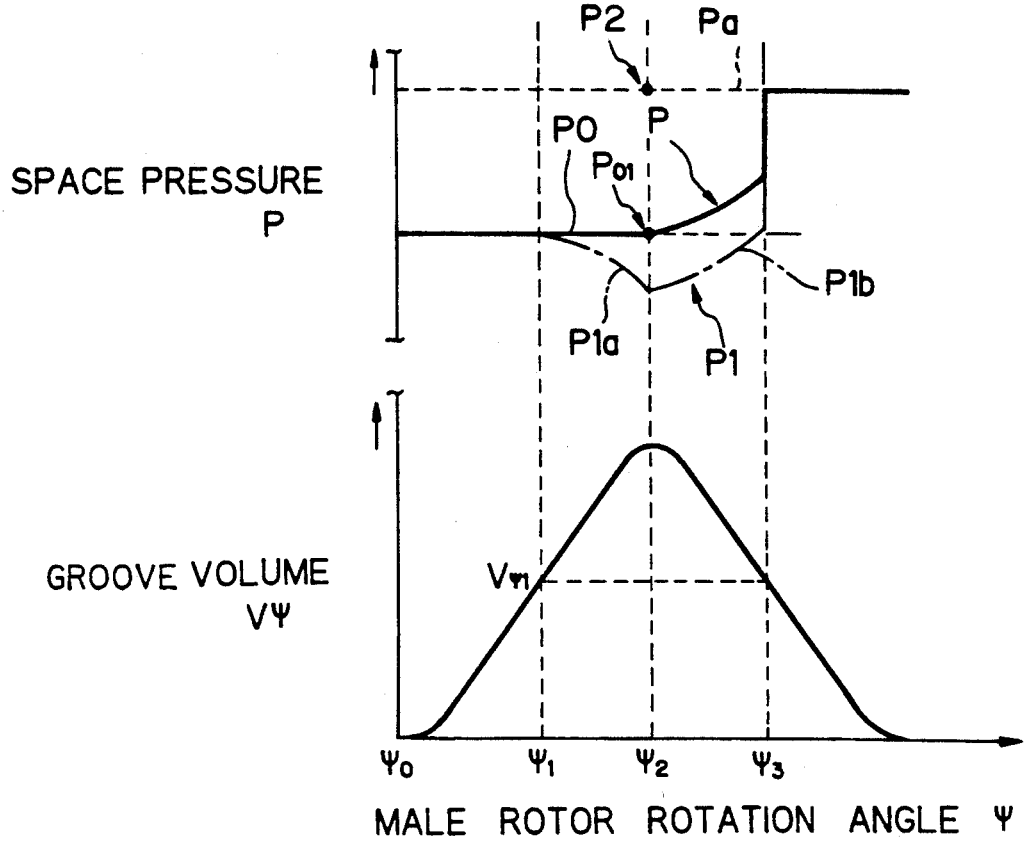
FIG. 4 shows the change of the groove volume with respect to the angle of rotation of the male rotor in the screw vacuum pump of the present invention.

The operation of the present invention will next be explained with reference to FIG. 4. FIG. 4 shows the change of the groove volume V with respect to the angle $\psi$ of rotation of the male rotor 7. Pa denotes the atmospheric pressure, and the one-dot chain line shows the change of pressure in the groove space in the present invention, while the solid line shows the change of pressure in the groove space in the prior art. In FIG. 1, reference numerals 31a and 31b denote points at the male rotor rotation angle $\psi$1; 11a, 11b denote points at the male rotor rotation angle $\psi$3; 30a, 30b denote points at the male rotor rotation angle $\psi$2; and 10a, 10b denote points at the male rotor rotation angle $\psi$2.

In the prior art, while the groove volume $V\psi$ is increasing, that is, while the rotation angle is in the range of $\psi$0 to $\psi$2, some groove spaces are open to the suction port 8b to allow a gas to be sucked. Near the rotation angle $\psi$2 at which the groove volume $V\psi$ reaches a maximum value Vmax, the suction port 8b is closed for these groove spaces. In the case where the compression ratio is greater than 1, the groove volume $V\psi$ decreases thereafter until the rotation angle reaches $\psi$3 at which angle a predetermined space pressure P is reached, and the gas in the groove spaces is compressed. At the rotational angle $\psi$3, the groove spaces are open to the discharge port 9b, and the gas in the groove spaces is discharged at the discharge pressure (atmospheric pressure) Pa.

With regard to the change of the space pressure P in the prior art during the rotation from the angle $\psi$0 to the angle $\psi$3, the space pressure P becomes higher than the suction pressure P0 from an angular position immediately after the rotation angle $\psi$2 at which the suction port 8b is closed for certain groove spaces, thus causing leakage of gas to the suction side. In the case where the compression ratio is 1, the pressure changes according to the sequence of P0→P01→P2, so that the leakage of gas to the suction side increases furthermore.

In contrast, in the present invention the suction port 8b is closed for the pair of groove spaces C1 and C2 at the rotation angle $\psi$1 before the groove volume $V\psi$ reaches the maximum value Vmax to cut off the groove spaces C1 and C2 from the suction side. In consequence, while the rotation angle is in the range of $\psi$1 to $\psi$2, as the groove volume $V\psi$ increases, the space pressure P1 lowers as shown by the one-dot chain line P1a. Thereafter, the compression process starts. In a case where the compression ratio is 1, the space pressure P1 is maintained at a pressure P1b lower than the suction pressure P0 until the rotation angle reaches $\psi$3 at which the groove volume $V\psi$ becomes approximately equal to the groove volume $V\psi$1 at the rotation angle $\psi$1. Accordingly, leakage of gas to the suction port can be prevented. Thus, since there is no rise in the pressure in the groove space, even when a sublimable process gas is to be evacuated, there is a small possibility of the gas becoming solid. Therefore, the reliability of the vacuum pump is improved.

In the foregoing description, leakage of gas between the groove spaces is ignored for simplification of explanation. In actual practice, however, there are small clearances between the meshing portions of the male and female rotors and between the rotors and the casing, and there is therefore leakage of gas into the groove spaces from the discharge side, and the actual compression ratio exceeds 1. Accordingly, the design compression ratio may be set at a value greater than 1 with the leakage of gas taken into consideration. If the driving machine has a sufficiently large capacity, the compression ratio may be increased to delay the timing at which the groove space opens to the discharge port, thereby increasing the number of groove spaces present between the suction and discharge ports.

Although the above-described embodiment shows an arrangement comprising a single screw vacuum pump, it should be noted that a plurality of screw pumps having the above-described arrangement may be connected in series in a multi-stage structure by connecting the suction opening 8*a* of each pump to the discharge opening 9*a* of the preceding one. In this case, if the pumping speed of each screw vacuum pump is set to be either approximately equal to or higher than that of the preceding pump, there is no occurrence of such an undesirable phenomenon that the gas is compressed between a pair of adjacent vacuum pumps at the time, for example, of evacuation of a gas of atmospheric pressure. Thus, the load can be reduced, and it is possible to attain a higher degree of vacuum.

As has been described above, the present invention provides the following advantageous effects:

(1) Since there are a large number of groove spaces between the discharge and suction ports, a high degree of vacuum can be attained.

(2) Since there is no rise in pressure in the groove spaces, even when a sublimable process gas is to be evacuated, there is a small possibility of the gas becoming solid in the groove spaces, and the reliability of the vacuum pump is improved.

(3) By setting the compression ratio at about 1, it becomes possible to reduce the power needed at the time of evacuation of a gas of atmospheric pressure.

Obviously, numerous modifications and variations of the present invention are possible in light of the above teachings. It is therefore to be understood that within the scope of the appended claims, the invention may be practiced otherwise than as specifically described herein.

What is claimed is:

1. A screw vacuum pump, which comprises:

a male and female rotor rotating in mesh with each other around two parallel axes, respectively, a casing for accommodating said rotors, said casing having a suction port and a discharge port, said casing and said rotors having a groove space formed therebetween wherein a rotor rotation angle at which said suction port closes said groove space formed by said casing and said rotors is set at an angle at which the volume of said groove space has not yet reached a maximum, and wherein said discharge port is formed so that $V_1/V_2$ is about 1, where $V_1$ is a groove volume defined by said casing and said rotors immediately after a gas has been trapped, and $V_2$ is a groove volume immediately before the gas is discharged.

2. A screw vacuum pump as claimed in claim 1, wherein $V_1/V_2$ is in a range of 1.5 to 0.51.

3. A pump apparatus comprising a plurality of screw vacuum pumps which are connected in series in a multi-stage structure, each of said screw vacuum pumps comprising:

a male and female rotor rotating in mesh with each other around two parallel axes, respectively, a casing for accommodating said rotors, said casing having a suction port and a discharge port, said casing and said rotors having a groove space formed therebetween wherein a rotor rotation angle at which said suction port closes said groove space formed by said casing and said rotors is set at an angle at which the volume of said groove space has not yet reached a maximum, and wherein said discharge port is formed so that $V_1/V_2$ is about 1, where $V_1$ is a groove volume defined by said casing and said rotors immediately after a gas has been trapped, and $V_2$ is a groove volume immediately before the gas is discharged.

4. A pump apparatus according to claim 3, wherein the pumping speed of each screw vacuum pump is at least approximately equal to that of a preceding screw vacuum pump.

5. A pump apparatus as claimed in claim 3, wherein $V_1/V_2$ is in a range of 1.5 to 0.51.

* * * * *